US009089953B2

(12) United States Patent
Heidel et al.

(10) Patent No.: US 9,089,953 B2
(45) Date of Patent: Jul. 28, 2015

(54) RATCHETING TOOL WITH FINE TOOTHING

(71) Applicant: Eduard Wille GmbH & Co. KG, Wuppertal (DE)

(72) Inventors: Dieter Heidel, Schwelm (DE); Hans-Joachim Mehlau, Solingen (DE); Joachim Wilhelm, Wuppertal (DE); Michael Backhaus, Dortmund (DE)

(73) Assignee: Eduard Wille GmbH & Co. KG, Wuppertal (DE)

( * ) Notice: Subject to any disclaimer, the term of this patent is extended or adjusted under 35 U.S.C. 154(b) by 0 days.

(21) Appl. No.: 14/465,343

(22) Filed: Aug. 21, 2014

(65) Prior Publication Data

US 2015/0053051 A1 Feb. 26, 2015

(30) Foreign Application Priority Data

Aug. 26, 2013 (DE) ..... 20 2013 103 841 U

(51) Int. Cl.
*B25B 13/46* (2006.01)

(52) U.S. Cl.
CPC ..... *B25B 13/463* (2013.01); *B25B 13/465* (2013.01)

(58) Field of Classification Search
CPC .. B25B 13/463; B25B 13/465; B25B 23/0035
USPC ..... 81/58, 60–63, 63.2
See application file for complete search history.

(56) References Cited

U.S. PATENT DOCUMENTS

| | | | | |
|---|---|---|---|---|
| 4,748,875 | A | 6/1988 | Lang | |
| 6,101,902 | A | 8/2000 | Wei | |
| 6,282,991 | B1 * | 9/2001 | Hu | 81/63.2 |
| 6,575,060 | B1 * | 6/2003 | Tseng et al. | 81/63.2 |
| 6,711,973 | B2 * | 3/2004 | Arnold et al. | 81/63.2 |
| 6,935,213 | B2 * | 8/2005 | Shu-Sui et al. | 81/63.2 |
| 7,121,171 | B2 * | 10/2006 | Hsien | 81/63.2 |
| 2004/0200322 | A1 | 10/2004 | Hu | |
| 2006/0027050 | A1 | 2/2006 | Hsien | |
| 2011/0067531 | A1 * | 3/2011 | Suzuki | 81/63 |
| 2013/0152742 | A1 | 6/2013 | Chen | |

FOREIGN PATENT DOCUMENTS

| | | | |
|---|---|---|---|
| DE | 6808518 | U | 9/1971 |
| DE | 20210731 | U1 | 11/2002 |
| DE | 202007014032 | U1 | 12/2007 |
| DE | 202012102520 | U1 | 8/2012 |

* cited by examiner

*Primary Examiner* — Lee D Wilson
*Assistant Examiner* — Melanie Alexander
(74) *Attorney, Agent, or Firm* — Lawrence G. Fridman, Esq.

(57) ABSTRACT

A ratcheting tool comprises a drive housing provided with a housing cover and an actuating lever. A drive is arranged in the drive housing, wherein the drive comprises a rotary part with toothing rotatably supported in the drive housing. A connector serves for receiving plug-on or plug-in tools. A locking pawl is pivotally arranged in the drive housing, wherein the locking pawl comprises a toothing which engages the toothing of the rotary part for transmitting torque in one direction of rotation. A switch sets the direction of rotation and the engagement of the toothing of the locking pawl into the toothing of the rotary part. A hinge connection connects the locking pawl to the switch, wherein the switch comprises a switching pin which is rotatably supported in the drive housing.

5 Claims, 7 Drawing Sheets

RATCHETING TOOL WITH FINE TOOTHING

RELATED APPLICATIONS

This Application claims priority of German Utility Model Application No. 20 2013 103 841.5 filed Aug. 26, 2013, which Application is hereby incorporated in its entirety by reference.

FIELD OF THE INVENTION

This invention relates to tools in general, and more particularly it relates to ratcheting tools for tightening or loosening screw connections.

BACKGROUND OF THE INVENTION

Ratcheting tools are often required in engineering in general and the automotive and/or aircraft industries specifically. The ratcheting tools are typically used where it is necessary to connect components with screws. The ratcheting tool, also called a ratchet, consists of a lever arm and a tool head. The tool head comprises a drive housing in which a rotating part, typically a gear wheel is rotatably mounted. A connector for a plug-on or plug-in tool is connected to the drive. A locking pawl in the drive housing permits only one direction of rotation of the gear wheel. In this way, a torque is transmitted in one direction of rotation and in the other direction of rotation the lever arm can be return to a starting position. Thus, during operation the ratcheting tool should not be removed from the screw. With a switch, the locking pawl can lock the gear wheel in one direction of rotation as well as in the other direction of rotation. This allows setting a clockwise rotation or a counter-clockwise rotation for transmitting torque.

The Taiwanese Patent M434 653 discloses a ratcheting tool with a drive housing and a lever attached to it. In the drive housing, a gear wheel is rotatably mounted. On the gear wheel a square profile is provided as a plug for a plug-on tool. A switch selects between two spring-loaded locking pawls in the drive housing. The switch sets the locking pawls into suitable locking positions. Each of the locking pawls allows only one direction of rotation of the gear wheel. Hence, depending on the switch position of the switch either the clockwise rotation or the counter-clockwise rotation is set up. Different lock-in positions are provided for the switch. A housing cover closes the drive housing. Only the male square profile of the connector protrudes through an opening in the housing cover.

German Patent document DE 20 2012 102 520 U1 discloses a wrench with a ratchet. The wrench comprises a ratchet body, a drive mechanism, a cover ring and a regulating part. An opening is provided at one end of the ratchet body. A receiving space is formed axially in an inner wall of the opening and corresponding to the ratchet body, wherein the receiving space coincides with another end of the ratchet body. The wrench further includes a lateral indenting opening on one side of the receiving space. An insertion groove is formed axially in a bottom of the receiving space and according to the ratchet body. The regulating part is inserted into this insertion groove. Furthermore, a positioning groove is provided axially in a bottom of the insertion groove and corresponding to the ratchet body. The drive mechanism is made up of a ratchet and a drive element. The ratchet is inserted in the opening. Around an outer periphery of the ratchet a toothing is provided. The drive element is inserted in the receiving space wherein an abutment surface is formed at each of the two ends of the drive element. The two abutment surfaces rest on the bottom of the receiving space. On one side of the drive element two indenting toothings are provided which are arranged close to each other. The two indenting toothings are formed according to the ratchet, while the toothing of the ratchet is selectively indented in one of the two indenting toothings. The opening and the lateral indenting opening of the receiving space are covered by a covering ring. The covering ring is provided with an opening, wherein the opening is formed in accordance with the ratchet and retains a top side of the ratchet. The regulating part is composed of a switching element, a first elastomer and a second elastomer. The switching element is inserted into the insertion groove and can rotate therein. The switching element comprises two adjacent notches. The positioning groove is selectively formed in accordance with one of the two notches. The first elastomer is inserted in the positioning groove for selectively abut against one of the two notches of the switching element. The second elastomer is attached to the switching element, to abut against the drive element. When rotating the ratchet about the ratchet body in one direction, the toothing of the ratchet is indented in one indenting toothing of the drive element. During the rotation of the ratchet about the ratchet body in the other direction, the toothing of the ratchet is gradually disengaged from an indenting toothing of the drive element.

German Patent document DE 1 678 400 teaches a reversible ratchet. The reversible ratchet is adapted for transmitting torque exerted by a drive lever to a tool actuated by the ratchet, for example a socket wrench for tightening nuts, bolt heads, etc., wherein the ratchet comprises a head with a drive lever, a recess and a therein disposed ratchet wheel, which is toothed on its circumference and has a coupling shaft for mounting the tool. The ratchet comprises a drive lever, a ratchet wheel and a ratchet mechanism, the latter including a pawl by means of which the rotational force is transmitted from the drive lever to the driven ratchet. Many designs are characterized by a single, double-acting locking pawl which is moved between two different positions or oscillates back and forth about a centrally mounted pin. The shapes and arrangements of the various pawls are such that a high bending stress or shear stress is created in the locking pawl when a stress occurs by means of the drive lever. A switching lever comprises a bearing pin. The switching lever has a locking mechanism which can be clicked into two positions. For this purpose, the bearing pin comprises a blind bore into which a spring-loaded ball is inserted. The ball can engage in two notches and thus two positions.

German Patent document DE6808518 U relates to a lever wrench with a ratchet for two directions of rotation, consisting of a ratchet wheel carrying the driver fitting, the ratchet wheel carrying a toothing on its circumference, and a blocking member with a counter-toothing of the same radius which is pressed against the ratchet wheel by a spring. One end of the spring is arranged in a rotating body which can be rotated by means of a manually operable lever for selecting the direction of rotation.

European Patent document EP 1961521 B1 provides a ratcheting tool. The ratcheting tool includes a body and a gear wheel, which is disposed in the body and has a plurality of teeth which define a circumference of the gear wheel. The ratcheting tool comprises a locking pawl with a plurality of teeth pointing to the gear wheel, wherein the pawl is disposed in the body so that the locking pawl with respect to the gear wheel is laterally movable between a first position in which the pawl is arranged between the body and the gear wheel, so that the body transmits torque via the pawl in a first rotational direction, and a second position in which the pawl is arranged between the body and the gear wheel so that the body transmits torque via the pawl in an opposite direction of rotation. The document also discloses an externally operable change-over switch, with which the direction of rotation and the engagement of the toothing with the gear wheel for transmitting torque is set. The ratcheting tool includes a hinge connecting the pawl to the switch, wherein the switch is provided with a switching pin which is rotatably mounted in a body and has a projection, which engages in a recess of the locking pawl for switching. A blind hole with a spring is provided in the switching pin of the switch. A spring-loaded hinge pin is provided in the blind bore on the side facing the hinge, which passes through the projection of the switching pin into the recess of the pawl.

An essential drawback of the prior art is that that the switching mechanism for the ratchet drive is relatively complicated with many individual components. This makes the production of such tools expensive. With respect to the prior art ratchets it has been found that the switching mechanism switches uncontrollably by itself in a highly undesirable manner.

In view of the above, it has been long felt and unsolved need to provide a ratcheting tool which avoids the disadvantages of the prior art and to provide a switching mechanism for ratcheting tools constructed simply and inexpensively, wherein the switching mechanism is prevented from switching by itself during operation.

SUMMARY OF THE INVENTION

One aspect of the invention provides a ratcheting tool for tightening or loosening screw connections comprising: a drive housing which provided with a housing cover for sealing, an actuating lever at the drive housing, a drive arranged in the drive housing, wherein the drive comprises a rotary part with a toothing which is rotatably supported in the drive housing, a connector for receiving plug-on or plug-in tools, the connector is provided on the rotary part, a locking pawl pivotally arranged in the drive housing, and the locking pawl comprises a toothing which engages the toothing of the rotary part for transmitting torque in one direction of rotation, an externally operable switch sets the direction of rotation and the engagement of the toothing of the locking pawl into the toothing of the rotary part for transmitting torque, a hinge connection connects the locking pawl to the switch, wherein the switch comprises a switching pin is rotatably supported in the drive housing and comprises a projection which engages a recess of the locking pawl for switching over, and a latching mechanism with which the switch is latchable at one position.

Another aspect of the invention provides a ratcheting tool, wherein diametrical hole with a spring is provided in the switching pin of the switch, wherein a spring-loaded detent ball is provided on one side of the diametrical hole which engages a corresponding notch of the drive housing for latching, and a spring-loaded hinge pin is provided on the other side of the diametrical hole which passes through the projection of the switching pin into the recess of the locking pawl.

The invention uses as few components as possible for the ratcheting tool. In the prior art, one clamping mechanism for the hinge between the locking pawl and the switching pin of the switch is used as well as another clamping mechanism for a latching mechanism for the switch. These are separate functional elements of the ratcheting tool. In the development of the invention, has been uncovered that the clamping mechanism of the hinge and the locking mechanism can be combined. For this purpose and according to the invention, a diametrical through bore hole is provided in the switching pin of the switch. In this hole there is a spring element, usually a spiral spring. On the hinge facing side of the hole, a hinge pin is provided while a detent ball on the opposite side engages one or more notches of the drive housing during switching. This measure ensures that two separate spring mechanisms must not be used. This saves manufacturing costs and simplifies the structure of the ratcheting tool.

According to still another aspect of the invention, the connector of the ratcheting tool is a polygonal pin for receiving plug-on tools, which is arranged centrally on the gear wheel and is passed through the drive housing. An effect of this measure is that insert tools can be connected to the ratcheting tool easily. Numerous plug-on tools have a corresponding polygonal fitting, a polygonal inner profile. Thus, the ratcheting tool can be used universally for most of the insert tools.

According to a further aspect of the invention, the locking pawl comprises a wedge-shaped region which is supported by a side wall of the drive housing when transmitting torque. The wedge-shaped region locks the locking pawl in such a manner that the rotary part is no longer able to rotate in one rotational direction. The toothing of the rotary part fixedly engages the toothing of the locking pawl. In this locked position torque can be transmitted by means of the ratcheting tool. If now it is tried to transmit a torque in the other direction of rotation, the wedging of the locking pawl disengages. The toothing of the locking pawl rattles over the toothing of the rotary part of the drive.

According to a different aspect of the invention, in the ratcheting tool a side wall of the drive housing and/or the drive comprises a groove-shaped recess, in which fastening means for fastening of the drive housing bottom are provided. Especially in aircraft maintenance or in aircraft construction small parts must not get into the turbine blades. Such small parts could destroy the turbines, with disastrous consequences. Often it was not noticed that a screw or rivet fell off. At the ratcheting tool of the invention, the housing bottom is not secured with screws any longer. The housing bottom is fixed by fasting means in a groove of the side wall of the housing or the drive part. The groove-shaped recess is generally located on the inside of the drive housing. Lug-shaped fasteners engage in this groove-shaped recess for attaching the housing bottom to the housing of the ratcheting tool. In doing so, it can be avoided to use small parts like screws or rivets for securing the housing bottom. These can detach themselves in the worst case. By a groove in the drive part, a fastener, for example an accordingly wide snap ring, can fix the housing cover to the housing. The snap ring is seated in the groove-shaped recess of the drive part and thus cannot slip. This keeps the housing bottom firmly in place without screws and the like.

According to a still further aspect of the present invention, the housing bottom is provided wholly or partly made of plastic. This is advantageous in the manufacture. An injection-molded part can be produced quickly and inexpensively. In addition, the plastic housing bottom can be mounted easily on the housing of the ratcheting tool, because plastic is regularly elastic. The housing bottom or the fastening means can then be easily placed into the groove-shaped recess. The elasticity also has the advantage that the plastic has a damping effect and absorbs vibrations. During assembling the arm of the installer does not tire as quickly.

According to a still another aspect of the present invention, the edge of the housing bottom comprises a clipping lip as fastening means which is clipped into the groove-shaped recess of the drive housing of the ratcheting tool for sealing. This type of fastening of the housing bottom allows easy fixing to the drive housing, even with a non-elastic material for the housing bottom. The clipping lip securely clips in the housing bottom to the drive housing and can be detached from the housing wall only with a special tool or by force.

DETAILED DESCRIPTION OF THE INVENTION

Figure 1:
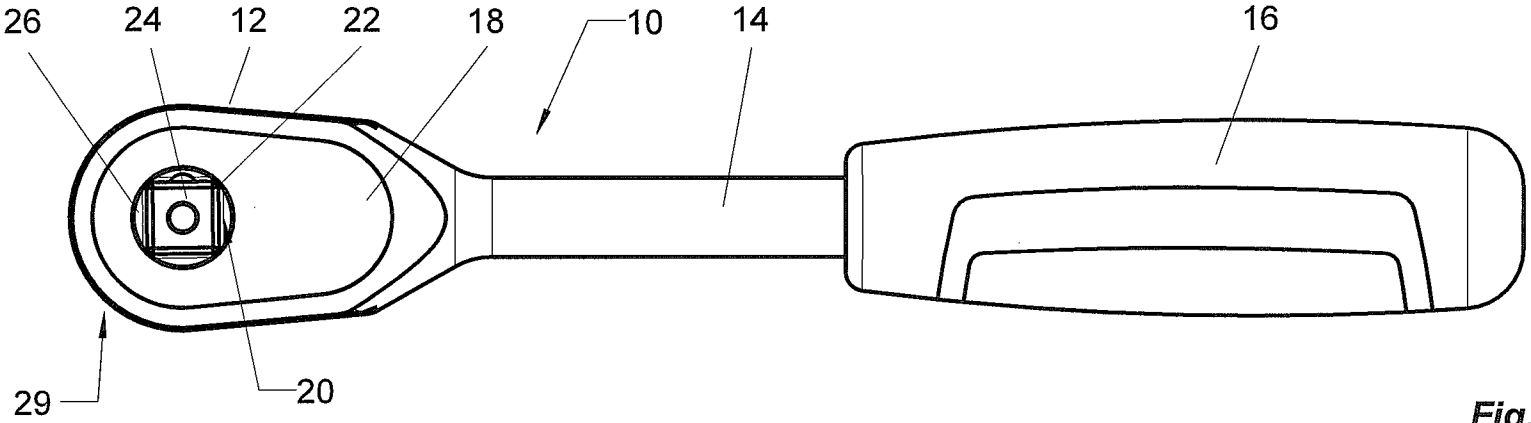
FIG. 1 is a bottom view of the ratcheting tool of the invention.

Referring now to FIG. 1, wherein a ratcheting tool is generally designated by the numeral 10, and is shown from the bottom. The ratcheting tool 10 comprises a drive housing 12 to which a lever 14 is provided. A plastic handle 16 increases comfort for the operation of the ratcheting tool 10. The drive housing 12 is closed by a detachable housing bottom 18 at its underside. Only a connector 20 protrudes through an opening 22 of the housing bottom 18. The connector 20 is formed as an outer square profile 24. The outer square profile 24 is connected to a rotary part 26 of a drive 28 (see FIG. 3). The drive housing 12 together with the drive 28 form a tool head 29. The rotary part 26 is rotatably supported in the drive housing 12.

Figure 2:
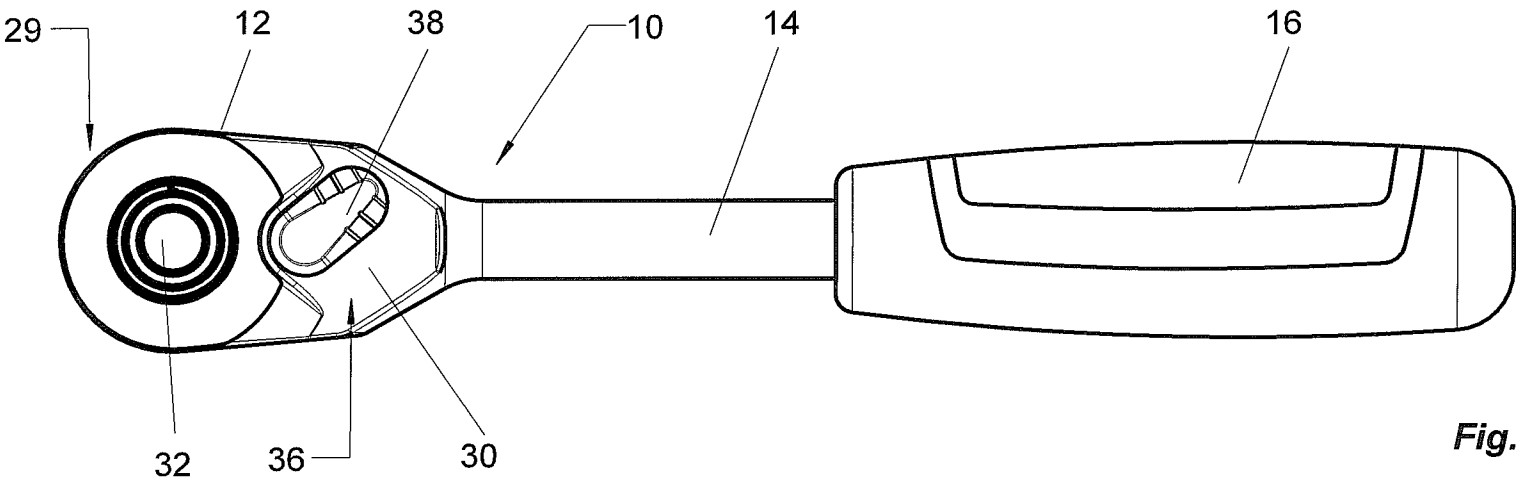
FIG. 2 is a top view of the ratcheting tool of the invention.

Referring now to FIG. 2, illustrating the ratcheting tool 10, as viewed from the upper side. The ratcheting tool 10 comprises the drive housing 12 to which the lever 14 is provided. The plastic handle 16 is located at one end of the lever 14. The drive housing 12 is closed by a housing cover 30. A control knob 32 is disposed on the opposite side of the outer square profile 24. This control knob 32 is part of a release mechanism 34 (see for example FIG. 3 or 4). The release mechanism 34 releases the connector 20 in a simple manner. In a recess 36 of the housing cover 30 the operating element 38 of a switching mechanism 40 (see for example FIG. 4) can be seen. With the switching mechanism 40 a clockwise rotation or an anticlockwise rotation can be set for transmission of torque.

Figure 3:
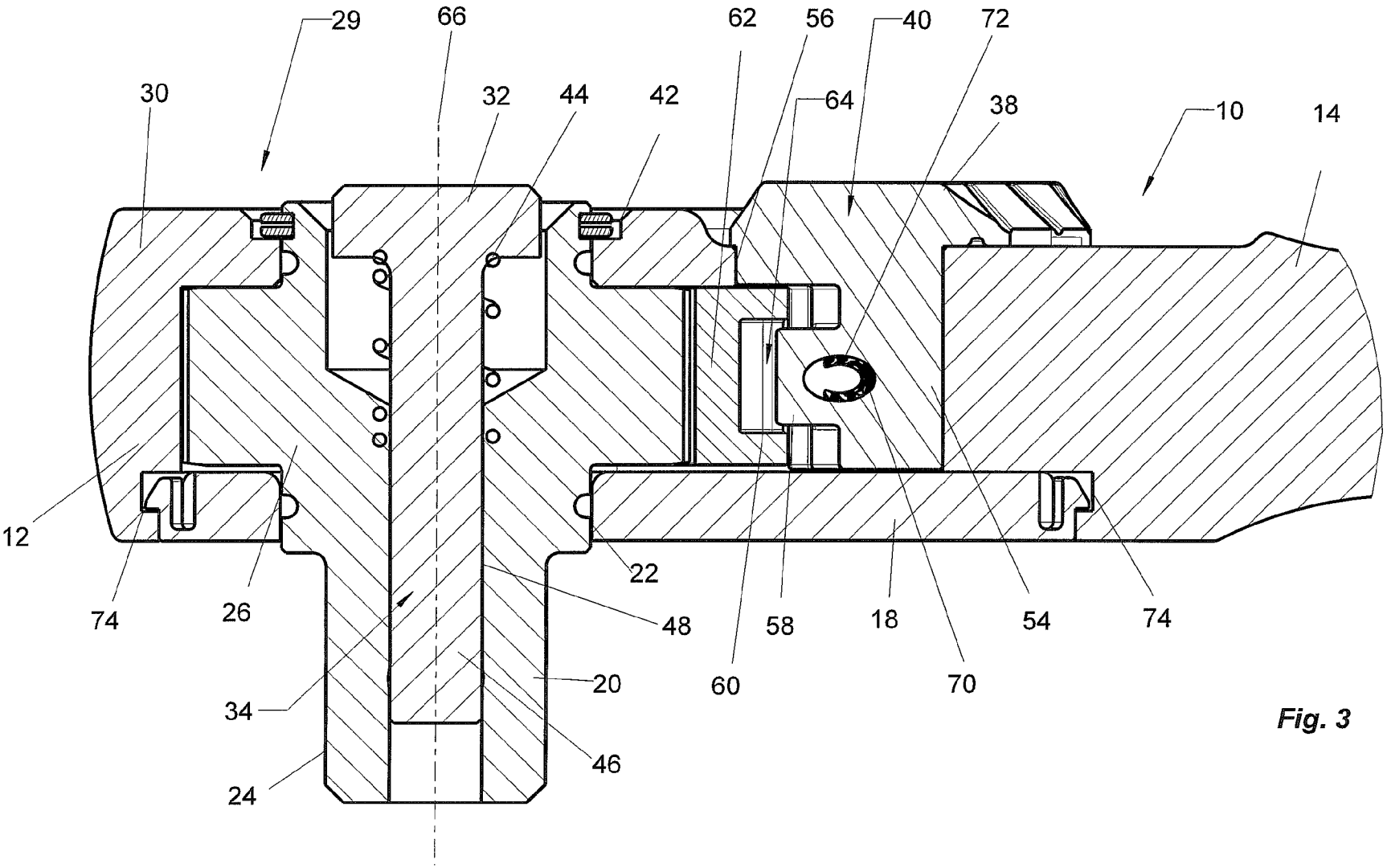
FIG. 3 is a longitudinal cross-sectional view of the ratcheting tool of FIGS. 1 and 2 in the area of the drive housing.

Referring now to FIG. 3, illustrating a longitudinal section of the ratcheting tool 10 in the area of the tool head 29. The lever 14 is only indicated. In the drive housing 12 the rotary part 26 is rotatably mounted. The rotary part 26 is formed as a gear wheel. For this purpose, the rotary part 26 is rotatably supported in the opening 22 of the housing bottom 18 and in an opening 42 of the housing cover 30. The connector 20 is formed as an outer square profile 24 and is located on the rotary part 26. The release mechanism 34 includes an unlocking pin 46 which is spring-loaded by a coil spring 44. The unlocking pin 46 is arranged axially in a central unlocking bore hole 48 of the rotary part 26 and extends into the connector 20. By actuating the control knob 32 which is provided on the unlocking pin 46, the unlocking pin 46 is pressed against the force of the coil spring 44 into the unlocking hole 48. Thus, a locking ball 50 in a recess 52 for the ball (see FIGS. 4 and 7) is released. An insert tool can be plugged on or removed from the connector 20.

Furthermore, a switching pin 54 of the switching mechanism 40 extends into the drive housing 12. For this purpose, the switching pin 54 is passed through a housing opening 56 of the housing cover 30 and is coupled at the upper end with the operating element 38 of the switching mechanism 40. By actuating the operating element 38 the switching pin 54 can be axially rotated for switching. The switching pin 54 of the switching mechanism 40 comprises a projection 58. The projection 58 extends into a hinge recess 60 of a locking pawl 62. The projection 58 and the switching pin 54 form a hinge connection 64. The locking pawl 62 is pivotally provided in the drive housing 12. Upon actuation of the operating element 38 the switching pin 54 affects the locking pawl 62 via the hinge connection 64. The locking pawl 62 then swivels about its pivot axis 66. The locking pawl 62 is provided with a toothing 68 facing the rotary part 26 (see also FIG. 4). A diametrical hole 70 with a spring 72 is provided in the switching pin 54.

The housing bottom 18 is snapped into a groove-shaped recess 74 within the drive housing 12. The side wall 76 of the drive housing 12 includes one or more groove-shaped recesses 74 for fastening of the housing bottom 18. The housing bottom 18 is made of plastic and has an accordingly sufficient elasticity. The housing bottom 18 is fixed in the groove-shaped recess 74 by one or more clipping lips 79.

Figure 4:
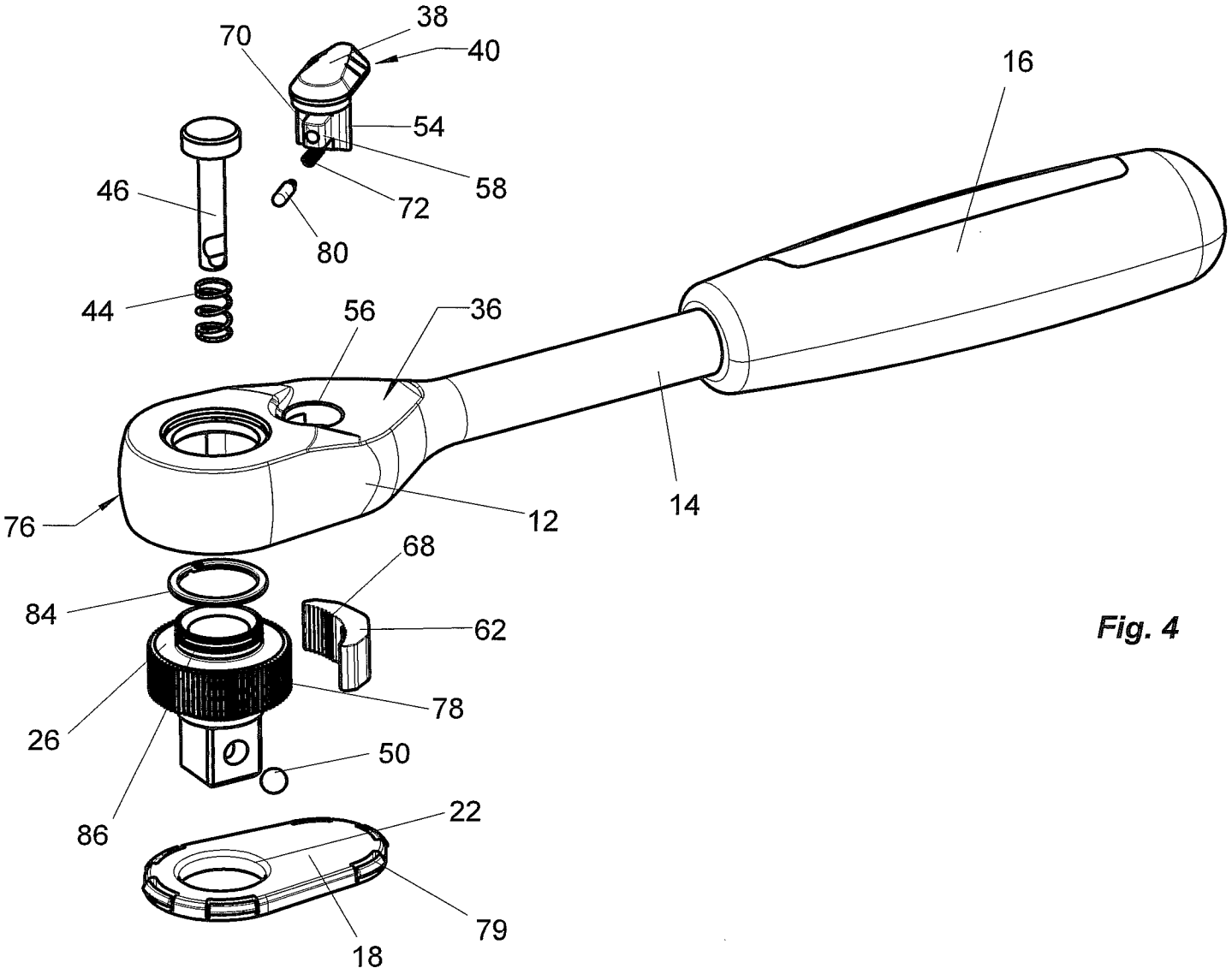
FIG. 4 is an exploded perspective view of the ratcheting tool of the invention.

Referring now to FIG. 4, which is an exploded perspective view of a ratcheting tool 10 of the invention. The drive housing 12 of the ratcheting tool 10 is connected to the lever 14. The rotary part 26 is provided with a fine toothing 78, which is arranged parallel to the toothing 68 of the locking pawl 62. In doing so, the toothing 68 of the locking pawl 62 can engage the toothing 78 of the rotary part 26.

The recess 36 for the switching mechanism 40 in the area of the housing opening 56 can be seen clearly. The switching pin 54 is removed together with the operating element 38. In this exploded view the projection 58 of the switching pin 54 is clearly shown. The diametrical hole 70 in the switching pin 54 passes through the projection 58 and includes the removed spring 72. The spring 72 biases a hinge pin 80 on the side of the projection 58. Therefore, the diametrical hole 70 passes through the projection 58. On the side opposite to the hinge pin 80 the spring 72 biases a detent ball 82 (see FIGS. 7 and 9). The detent ball 82 is also located in the diametrical hole 70, which cannot be seen in this perspective. The unlocking pin 46 releases the locking ball 50 on actuation of the control knob 32 against the spring force of the coil spring 44. The unlocking pin 46 is, as shown in FIG. 3 in cross-section, inserted into the unlocking hole 48 and axially into the rotary part 26. For the rotatable mounting of the rotary part 26 in the drive housing 12, for example, a snap ring 84 is used, for example, which engages in a groove 86 of the rotary part 26. The housing bottom 18 is made of plastic and is fixed to the side wall 76 of the drive housing 12 by the clipping lip 79.

Figure 5:
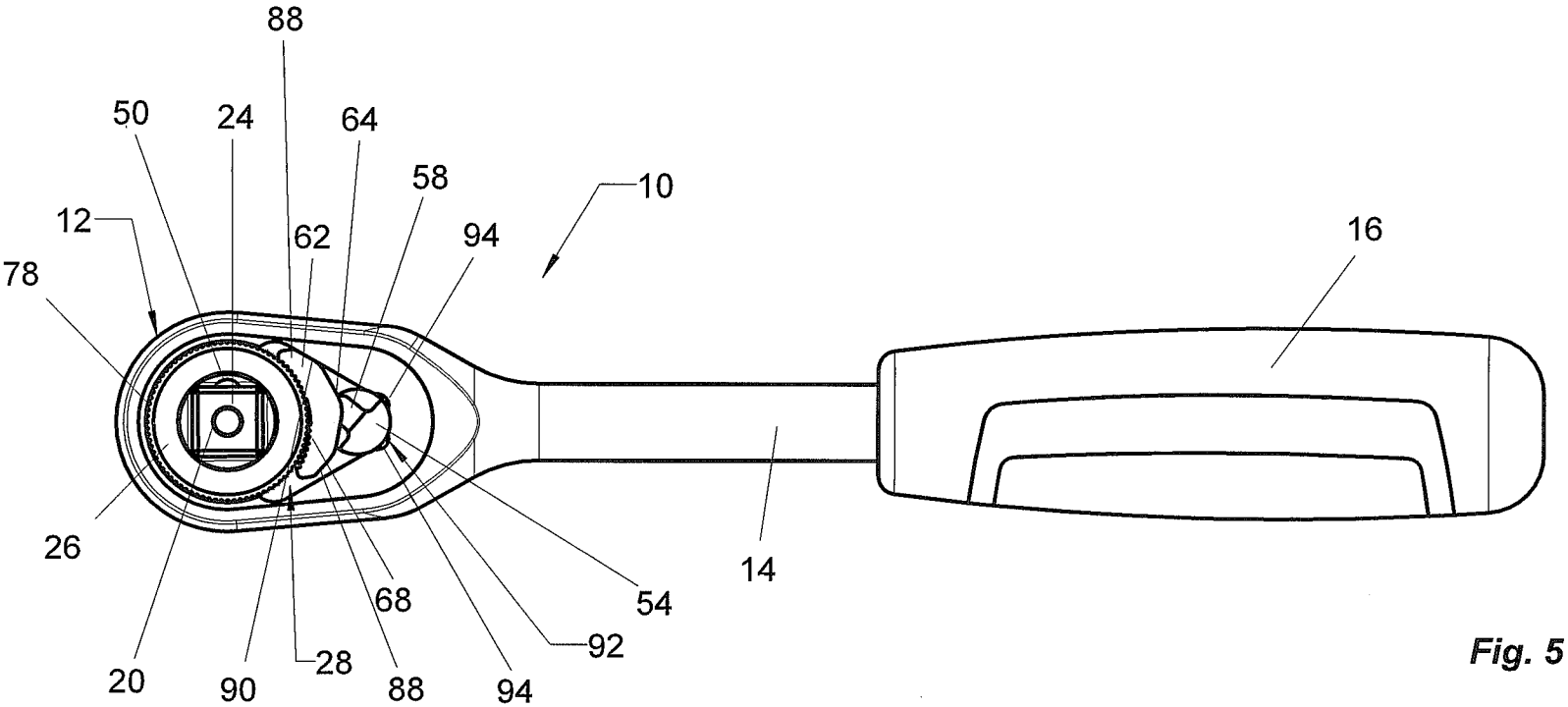
FIG. 5 is a top view of the tool of the invention without a bottom for the drive housing.

FIG. 5 shows a top view of the ratcheting tool 10 of the invention without the housing bottom 18 of the drive housing 12. The toothing 68 of the locking pawl 62 engages the toothing 78 of the rotary part 26. The locking pawl 62 comprises a wedge-like shape 88 on each side, which wedges with a corresponding housing surface 90 of the drive housing 90, depending on the direction of rotation of the rotary part 26. As a result, torque applied to the lever 14 in this direction of rotation can be transferred to a workpiece. For this purpose, the toothing 68 of the locking pawl 62 secures the toothing 78 of the rotary part 26 by a corresponding engagement. On movement of the lever 14 in the other direction of rotation, the wedging of the locking pawl 62 releases. The rotary part 26 can rattle over the locking pawl 62. In this rotational direction no torque applied to the lever 14 is transmitted. Only by operating the switching mechanism 40 the respective direction of rotation for transmitting torque can be changed. For this purpose, the operation element 38 of the switching mechanism 40 is actuated. Depending on the position of the operating element 38 the hinge connection 64 moves the locking pawl 62 via the switching pin 54 into one direction of rotation or into the opposite direction of rotation.

The drive housing 12 is tapered in the region of the switching mechanism 40 to a tapered shape, wherein the legs are the housing surfaces 90 used for the wedging of the locking pawl 62. At the head 92 of the tapered shape notches 94 are provided. These notches 94 are formed by recesses. The detent ball 82 of the switching pin 54 engages in these notches 94 and prevents an autonomous setting of the switching mechanism 40. The switching pin 54 can be rotated in the head 92 for switching.

A hinge pin 80 (see also FIGS. 7 and 9) is located on the side of the switching pin 54 diametrically opposite to the detent ball 82. The hinge pin 80 provides in particular a spring-loaded hinge connection 64. In this way, a movement of the locking pawl 62 is ensured by the switching mechanism 40.

Figure 6:
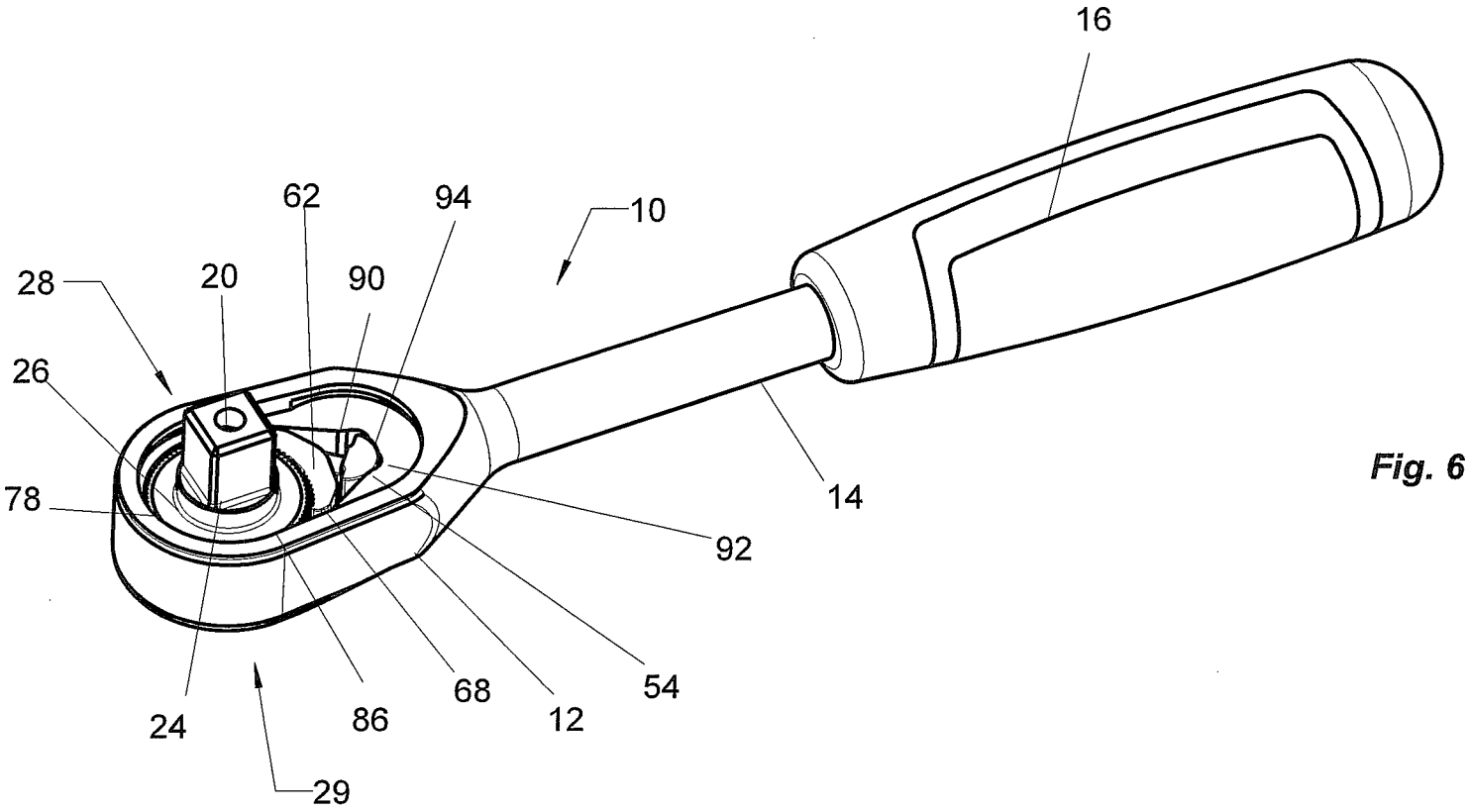
FIG. 6 is a bottom perspective view of the ratcheting tool with removed housing bottom.

FIG. 6 provides a perspective view of the ratcheting tool 10 with the removed housing bottom 18. The rotary part 26 is locked in a rotational direction by the locking pawl 62. Thus, a torque applied to the lever 14 can be transmitted via the connector 20 in this direction of rotation. The switching mechanism 40 switches over the locking pawl 62 as needed. Thus, a torque can be transmitted in both directions of rotation. In the other rotational direction the toothing 78 of the rotary part 26 clicks over the toothing 68 of the locking pawl, so that no torque can be transferred.

Figure 7:
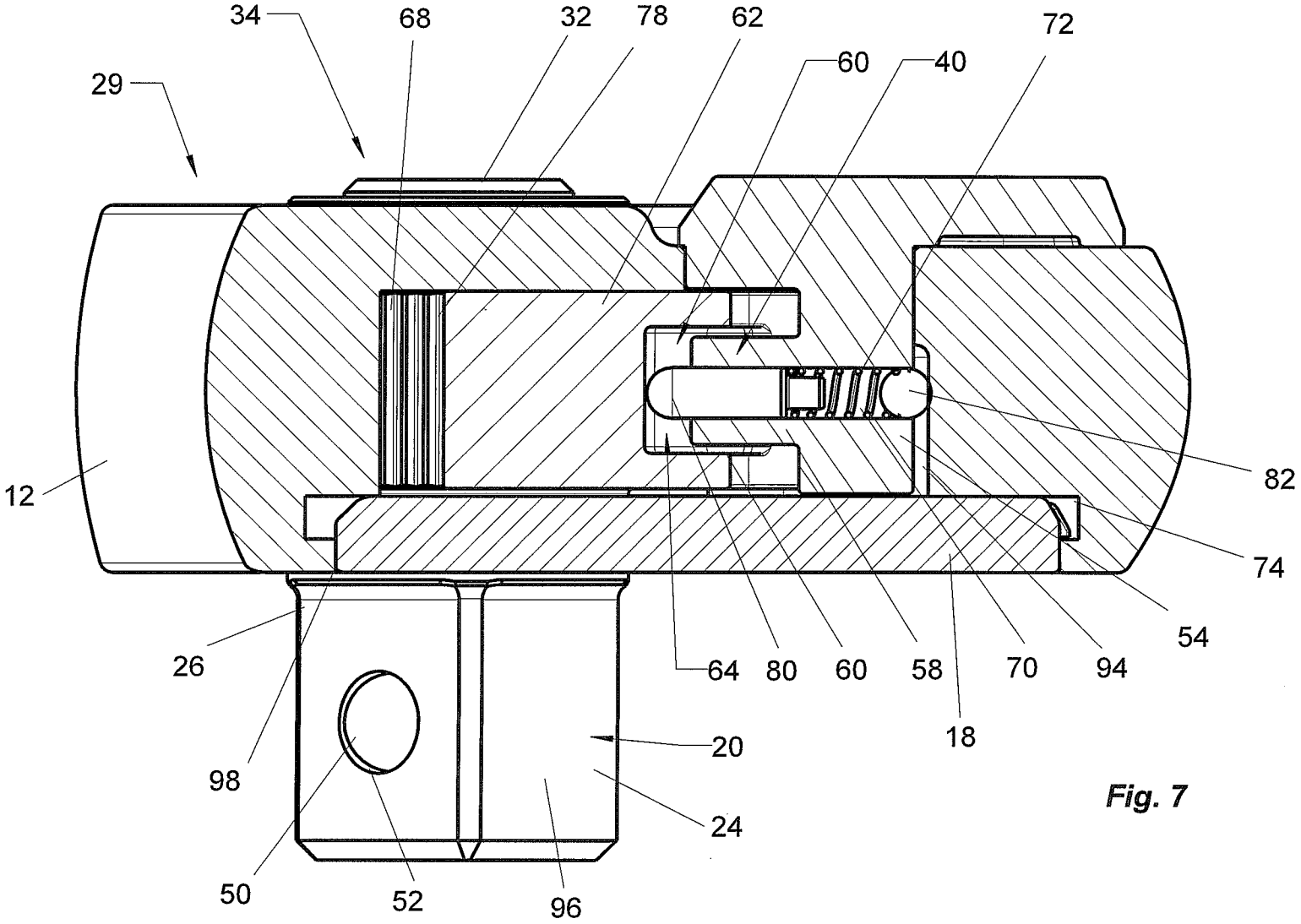
FIG. 7 is a further longitudinal sectional view of the ratcheting tool in the area of the drive housing.

FIG. 7 provides a further longitudinal section of the ratcheting tool 10 in the region of the tool head 29. In this figure, the switching mechanism 40 is particularly clearly visible. The switching pin 54 of the switching mechanism 40 is rotatably mounted in the drive housing 12. The projection 58 protrudes into the hinge recess 60 of the locking pawl 62. The engagement of the toothing 68 of the locking pawl 62 in the toothing 78 of the rotary part 26 for transmission of torque is also indicated.

The diametrical hole 70 through the switching pin 54 and the projection 58 can be seen in this section. The spring 72 is located in the diametrical hole and loads the hinge pin 80 on the side to the projection 58 and the detent ball 82 on the other side at the same time. The detent ball 82 engages in the notches 94 during actuation of the operating element 38 of the switching mechanism. By the notches 94 switching positions of the switching mechanism are defined. The switching pin 54 can only be moved over the notches 94. Thus, autonomous switching by changing the position of the ratcheting tool 10 is largely excluded. The hinge connection 64 is always biased by a spring load. At each displacement of the locking pawl 62, the hinge connection 64 engages precisely in order to lock the rotary part 26 for transmission of torque in one rotational direction.

On the rotary part 26 the connector 20 is provided as an outer square profile 24. The locking ball 50 is visible on a surface 96 of the outer square profile 24. The locking ball 50 is located in the ball recess 52 for the release mechanism 34. The control knob 32 for actuating the release mechanism 34 is visible. A bearing hole 98 supports the rotary part 26 in the opening of the housing bottom 18. The housing bottom 18 is secured in the groove-shaped recess 74 of the drive housing 12.

Figure 8:
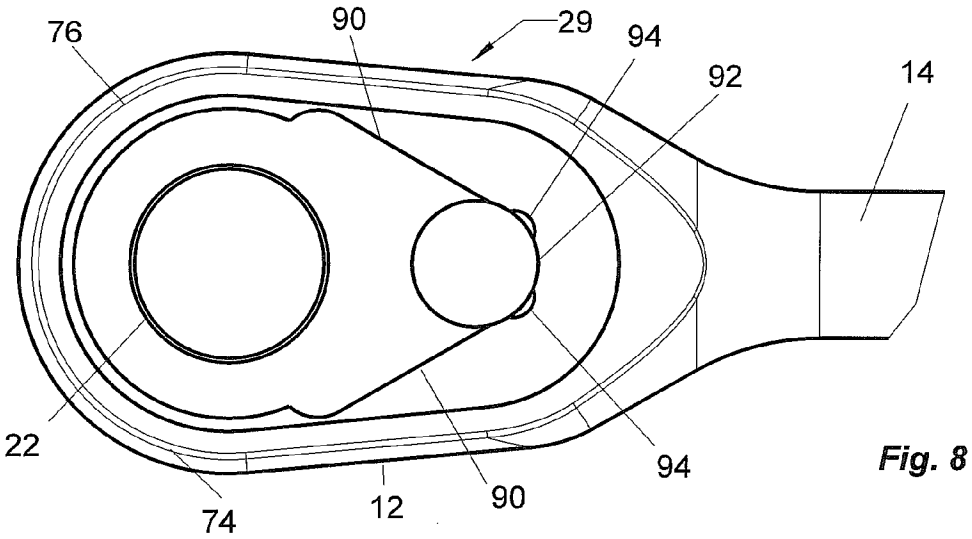
FIG. 8 is a top view of the drive housing of the ratcheting tool without drive and switching mechanism.

FIG. 8 is a top view of the drive housing 12 without the drive 28 and the switching mechanism 40 of the ratcheting tool 10. The drive housing 12 is tapered in the region of the switching mechanism 40 to the tapered shape, wherein the legs, the housing surfaces 90, serve for the wedging of the locking pawl 62. At the head 92 of the tapered shape the notches 94 are provided for the detent ball 82 of the switching mechanism 40.

Figure 9:
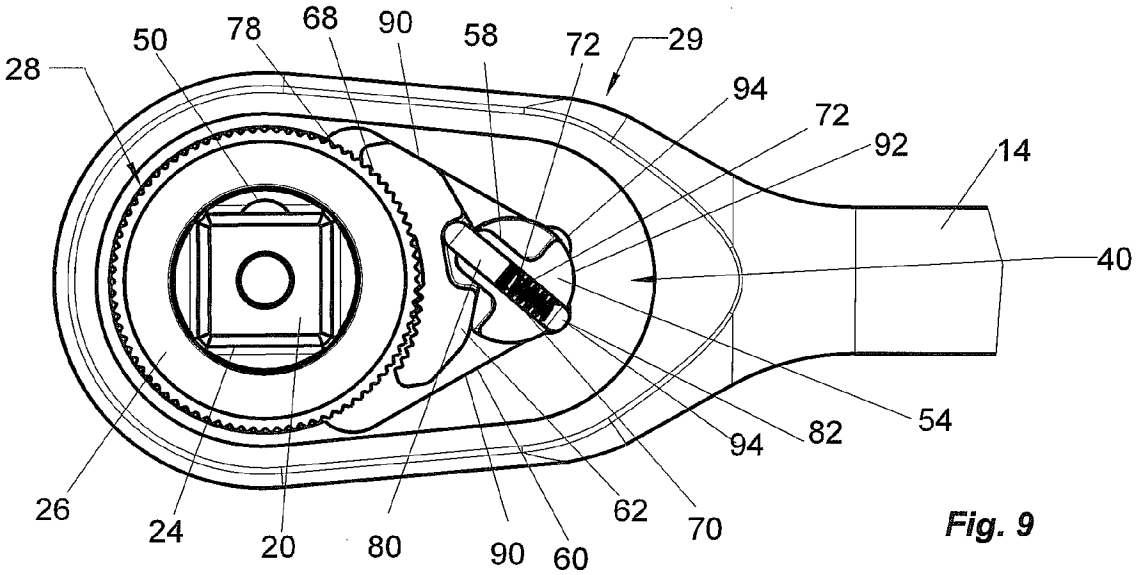
FIG. 9 is a view of an open drive housing of the ratcheting tool with a drive.

FIG. 9 shows, an open drive housing 12 of the tool head 29. The lever 14 for transmitting torque is only indicated. The drive housing 12 encloses the drive 28. The switching pin 54 of the switching mechanism 40 is rotatably mounted in the drive housing 12 in the region of the head 92 of the tapered shape. The projection 58 protrudes into the hinge recess 60 of the locking pawl 62. The engagement of the toothing 68 of the locking pawl 62 in the toothing 78 of the rotary part 26 for transmitting of torque is visible. For this purpose, the toothing 68 of the locking pawl 62 holds the toothing 68 of the rotary part 26 by a corresponding engagement. On movement of the lever 14 in the other direction of rotation, the wedging of the locking pawl 62 is released. The rotary part 26 can rattle over the locking pawl 62. In this rotational direction no torque applied to the lever 14 is transmitted.

In FIG. 9 the diametrical hole 70 through the switching pin 54 and the projection 58 is also apparent. In the diametrical hole 70 the spring 72 is arranged, which loads the hinge pin 80 on the side toward the projection 58 and the detent ball 82 on the other side at the same time. On actuation of the operating element 38 of the switching mechanism 40 the detent ball 82 engages the notches 94. The switching positions of the switching mechanism 40 are defined by the notches respectively. The switching pin 54 can only be moved over the notches 94. Thus, independent switching by changing the position of the ratcheting tool 10 is prevented. The hinge connection 64 is always biased by a spring. At each deflection of the locking pawl 62, the hinge connection 64 engages precisely in order to lock the rotary part 26 for transmission of a torque in one rotational direction.

What is claimed is:

1. A ratcheting tool for tightening or loosening screw connections, comprising:

a drive housing which is provided with a housing cover for sealing, an actuating lever at the drive housing, a drive which is arranged in the drive housing, wherein the drive comprises a rotary part with a toothing which is rotatably supported in the drive housing, a connector for receiving plug-on or plug-in tools, wherein the connector is provided on the rotary part, a locking pawl which is pivotally arranged in the drive housing, wherein said locking pawl comprises a toothing which engages the toothing of the rotary part for transmitting torque in one direction of rotation, an externally operable switch with which the direction of rotation and the engagement of the toothing of the locking pawl into the toothing of the rotary part for transmitting torque is set, a hinge connection which connects the locking pawl to the switch, wherein the switch comprises a switching pin which is rotatably supported in the drive housing and comprises a projection which engages a recess of the locking pawl for switching over, and a latching mechanism with which the switch is latchable at one position, a diametrical hole with a spring provided in the switching pin of the switch, wherein a spring-loaded detent ball is provided on one side of the diametrical hole which engages a corresponding notch of the drive housing for latching, a spring-loaded hinge pin is provided on the other side of the diametrical hole which passes through the projection of the switching pin into the recess of the locking pawl; and a side wall of said drive housing and said drive comprise a groove-shaped recess, in which fastening means for fastening of a drive housing bottom are provided.

2. A ratcheting tool according to claim 1, wherein said connector is a polygonal pin for receiving plug-on tools, which is arranged centrally on said rotary part and is passed through said drive housing.

3. A ratcheting tool according to claim 1, wherein said locking pawl comprises a wedge-shaped region supported by a side wall of said drive housing when transmitting torque.

4. A ratcheting tool according to claim 1, wherein said drive housing bottom is at least partially made of plastic.

5. A ratcheting tool according to claim 1, wherein said drive housing bottom comprises an edge which is formed as a clipping lip and is clipped in said groove-shaped recess of said drive housing as fastening means for sealing.

* * * * *